United States Patent [19]

Gurevich

[11] Patent Number: 4,988,969

[45] Date of Patent: Jan. 29, 1991

[54] HIGHER CURRENT CARRYING CAPACITY 250V SUBMINIATURE FUSE

[75] Inventor: Leon Gurevich, St. Louis, Mo.

[73] Assignee: Cooper Industries, Inc., Houston, Tex.

[21] Appl. No.: 512,730

[22] Filed: Apr. 23, 1990

[51] Int. Cl.[5] ..... H01H 85/16; H01H 85/14; H01H 85/38

[52] U.S. Cl. ..... 337/260; 337/273; 29/623

[58] Field of Search ..... 337/260, 255, 261, 262, 337/186, 216, 208, 273, 279, 280; 29/623

[56] References Cited

U.S. PATENT DOCUMENTS

| | | | |
|---|---|---|---|
| 4,417,226 | 11/1983 | Asdollahi et al. | 337/273 |
| 4,612,529 | 9/1986 | Gurevich et al. | 337/255 |
| 4,751,489 | 6/1988 | Spaunhorst | 337/255 |

*Primary Examiner*—H. Broome

*Attorney, Agent, or Firm*—Nelson A. Blish; Eddie E. Scott; Alan R. Thiele

[57] ABSTRACT

A subminiature fuse is disclosed comprising two terminals (20, 30), two substrates (80, 90), a fusible conductor (140), an insulating coating (180), and a unitary housing (170). The unitary housing is protected from the interrupt arc by the substrates (80, 90) and the housing (170) is sealed to provide increased mechanical strength, thus reducing the risk of a catastrophic failure of the fuse. The upper portion of the fuse terminals are shaped into finger like projections (70) adaptable to mechanically holding the fusible conductor (140) and a substrate (80), thus facilitating the manufacturing process. In one embodiment the fusible conductor and adjacent portions of the terminals and substrates are coated with a insulating coating or adhesive (180). The insulating coating (180) conducts heat away from the fusible conductor (140) during normal operation. To further protect the housing in the event of a short circuit interruption, a substrate (90) is placed between the housing and the fusible conductor. The housing is sealed by ultrasonic welding or may be an insert molded plastic enclosure which is substantially devoid of air.

28 Claims, 3 Drawing Sheets

HIGHER CURRENT CARRYING CAPACITY 250V SUBMINIATURE FUSE

TECHNICAL FIELD

This invention relates to fuses in general and more particularly to a subminiature electrical fuse used to protect electrical circuitry operating at greater than three ampere, where space is limited, and the circuit has a power factor less than 100 percent. This type of fuse is especially useful to save space on printed circuit boards and in applications requiring a high ampere subminiature fuse capable of providing protection to printed circuit board traces.

BACKGROUND OF THE INVENTION

Subminiature fuses, as with other types of fuses, are used to protect circuit components from damage that can be caused by excess current flowing through the circuit Excess current is generally categorized as either an overload current or a short circuit current. Overload current is generally considered to be in the range of 135 percent to 200 percent of normal ("rated") current. Short circuit current may be up to 1000 percent of rated current.

Conventional subminiature fuses run the risk of catastrophic failure during interruption of short circuit currents associated with high voltage (on the order of 250 Volts), and high ampere applications with a lower power factor. The circuit power factor relates to the inductive component of the load. The reduction of the power factor is associated with an increase in inductance of the circuit.

The voltage generated by the inductive component is related to the current rate by the equation:

$$V_1 = -L\frac{di}{dt}$$

Where: L is the inductance; i is the current; V is the voltage; and t is time. As is evident from the equation because of the short interruption time of the fast clearing fuse, the rate of current drop is often large relative to a slower clearing fuse. Thus it is possible to measure voltage across a fast clearing fuse that is three to four times higher than the RMS (Root Mean Squared) value of the nominal voltage of the AC circuit. Lower power factor circuits will result in higher voltage across the fuse. Higher voltage across the fuse means greater possibility of breakdown in the fuse.

Among other factors, the industry standard for fuse performance is based on three factors: (1) the maximum continuous current (the "current rating"); (2) the "peak current", and (3) $I^2t$ value associated with short circuit performance of the fuse at rated voltage. The current rating is the amount of current the fuse can sustain, continuously, without opening. The peak current is the maximum value of the current that downstream components will experience before the fuse interrupts the circuit. The $I^2t$ value is a measure of energy that the fuse will allow downstream components to experience during the interrupt event The purpose of the fuse protection is to minimize both the peak current and the $I^2t$ value while at the same time, maintain the desired current rating.

There are two components of $I^2t$. The first component is "melting $I^2t$" and it corresponds to the amount of energy the fuse will pass to downstream components before the starting of the arc. The second component is "arcing $I^2t$" and it corresponds to the amount of energy that the fuse will pass to downstream components during the arcing period after the fuse element has melted.

To minimize the $I^2t$ value and the peak current, the circuit interrupt (or "clearing of the fuse element") must occur as quickly as possible. In the normal fuse, the fuse element cross section is determined by the current rating desired For a given fuse element material, to obtain a higher fuse rating, larger cross sectional area for the fuse element is required to pass the current without overheating. Unfortunately, a larger cross sectional fuse element means that there is more material to melt. For a given overload level, larger cross sectional area for the fuse element will take longer to melt than smaller cross sectional area fuse element. Longer melting time is undesirable, because it results in larger $I^2t$ values and higher peak current values. Larger cross sectional area of the fuse element also means there is more material and a larger amount of current supplied for the subsequent arc, which also adds to the overall $I^2t$ value, further decreasing fuse performance. In the past, fuse performance had to be sacrificed to gain a higher fuse current rating Many conventional fuses are constructed from a fuse element and a two piece fuse housing comprising a cap and a base. During a short circuit condition, pressure inside the housing increases. Due to the small physical size of the subminiature fuse and hence the short arc clearing gap, the housing for such a fuse is subject to catastrophic failure problems that are not normally inherent in a physically larger fuse. There is a risk that the subminiature fuse housing will blow apart or rupture. In the two piece housing design, this normally occurs at the seal between the cap and the base. If the housing ruptures, this would not only expose a live arc but would also prolong that arc, thereby potentially causing damage to circuit components downstream of the fuse due to the additional time required to fully interrupt the circuit. Once the housing begins to leak, the pressure in the housing begins to decrease This causes the interruption time to increase.

Those skilled in the art know that when the fuse element is subjected to short circuit current, the fuse element heats up until it reaches the melting point of the fuse element conductor. The rate of the heat build up is, among other things, a function of the magnitude of the excess current. Once the temperature of the conductor reaches its melting point, the conductor material rapidly vaporizes mixing vaporized metal atoms with the gas or air medium surrounding the conductor. Upon vaporization, an arc is formed in the gas mixture which is created by the vaporization of the fuse element. The resulting plasma acts as a conducting path for the arc. The increased temperature of the arc plasma also increases the pressure of the fuse housing. If the arc plasma becomes dense, the travel of the charged particles in the plasma is restricted. Decreased mobility of the charged particles increases the resistance of the gap, thereby acting to extinguish the arc.

There have been several attempts to solve this problem of catastrophic fuse failure in subminiature fuses. One example is illustrated in the U.S. Pat. No. 4,417,226 to Asdollahi, et al. In this patent a ceramic lining is utilized in the interior of a two piece fuse housing to insulate the plastic body from the heat produced during a short circuit condition Merely coating the interior of an air filled fuse housing with a ceramic lining does not provide a fast clearing fuse. The relatively large interior volume of air and a low out-gassing ceramic lining prevents the quick pressure increase required for fast arc clearing. Lower pressure in the fuse housing tends to facilitate charged particle mobility in the plasma. Increased mobility in the plasma results in prolonged arcing. It is the prolonged arcing that generates the heat which jeopardizes the integrity of the fuse housing.

Other prior fuses utilized a ceramic coating around the fuse element. This coating will not work well if there are cracks in the coating or air pockets (voids) surrounding the fuse element. Cracking and voids are a problem with prior fuse designs. Air voids provide additional volume for expansion of the pressurized vapor during the interrupt process, decreasing resistance of the arc and increasing the interrupt time, thus decreasing fuse performance. Cracks in the ceramic coating contributed to premature fuse element overheating and melting. In the prior art fuses, the fuse element assembly was dipped into liquid ceramic material Due to the viscosity and surface tension of the liquid, there is not enough control over the amount or distribution of the material around the fuse assembly. As a result, air voids often remained in the ceramic material. Also, when the ceramic cures and contracts, cracks can form around the fuse element. As discussed above, both air voids and cracks decrease fuse performance.

Other examples of subminiature fuses are embodied in U.S. Pat. Nos. 2,941,059 to Sims, et al. and 3,775,723 to Mamrick, et al. Others have attempted, but have failed, to reduce this risk of catastrophic failure by improving the strength of the fuse housing to prevent rupture thereof.

The most effective fuse to date for this application is embodied in U.S. Pat. No. 4,612,529 to Gurevich et al. Although this fuse is effective for normal applications, it is not effective for 250 V applications above three amperes Other past fuse designs are susceptible to catastrophic failure when they were used in a circuit with a lower power factor (less than 100 percent)

Because of past failures, the need still exists to provide a subminiature fuse capable of properly interrupting short circuit or overload current with a power factor less than 100 percent with minimal risk of catastrophic failure. A higher ampere subminiature fuse device with a short duration of arcing time at low $I^2t$ values would be well received by the industry.

SUMMARY OF THE INVENTION

In accordance with the present invention, a subminiature fuse is disclosed for use primarily on circuit boards and other applications where physical space for electronic components is limited. The fuse assembly comprises two terminals, two substrates, a fusible conductor, and a ceramic coating The fuse assembly is encased in a one piece or unitary molded plastic body.

The present invention uses a fuse element that is smaller than conventional fuse elements with the same current rating. Normally this would result in overheating of the fuse element and premature circuit interruption. However, the present invention solves the heating problem by using a ceramic coating around the fuse element in order to conduct heat away from the element. Suitable ceramic coatings include, but are not limited to ceramic adhesive, stone sand, water glass, or other adhered fillers. The use of a ceramic to conduct heat is not obvious to those skilled in the art. Ceramics are normally thought of as good insulators. However, at room temperature, ceramics are much better heat conductors than air. A ceramic film surrounding the fuse element can transfer heat from the fuse element at a sufficient rate to obtain a significant increase in fuse performance utilizing smaller cross sectional area fuse element than was formerly possible.

The ceramic coating around the fuse element performs another function. When a short circuit or overload current is encountered, the ceramic coating contains the subsequent arc within the small volume formerly occupied by the fuse element. Ceramics have a high melting point and will not break down electrically when the fuse element is heated to its melting point. This means that the ceramic coating will not contribute ionized material to the arc, nor will it allow the metal vapor to expand, relieve the pressure, and reduce the resistance of the arc during the interrupt event. Increased resistance of the arc will lower peak current and $I^2t$ values The present invention solves the cracking and void problems that plagued prior fuses During the manufacturing process of the present invention, a small amount of the liquid ceramic is applied directly around the fuse element. Then a second (solid) ceramic substrate is pressed onto the ceramic coating, squeezing out any air pockets (voids). Because less ceramic material is applied into a smaller volume, there is less opportunity for cracks to form around the fuse element when the liquid ceramic hardens.

The second substrate performs an extra function. It isolates the fuse housing from the high temperatures associated with the interrupt event. During the interruption event, the temperature inside the fuse housing may rise above 400 degrees Fahrenheit. Because of this, both substrates are preferably capable of withstanding about 2000 degrees Fahrenheit. Suitable substrate materials include, but are not limited to alumina, silica, silica glass, magnesia, beryllia ceramic, mica and some organic fiber composites.

Both substrate also reinforces the ceramic coating surrounding the fuse element, allowing the ceramic coating to remain in place, thus withstanding the pressure during the arcing phase of the interrupt event. Because of the extra substrate, the fuse housing is insulated on both sides from the heat associated with the arc, thus helping to retain its integrity and decreasing the risk of catastrophic failure.

Numerous other advantages and features of the present invention will become readily apparent from the following description of the invention and its various embodiments, from the claims, and from the accompanying drawings.

Figure 7:
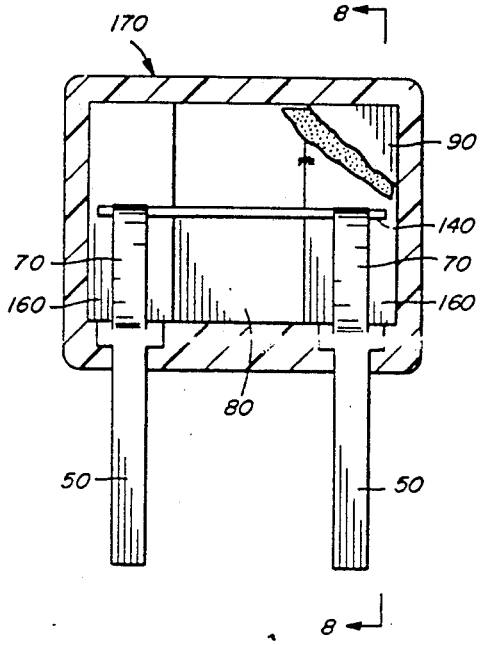
FIG. 7 is a sectional view of another embodiment of the fuse terminals of the subminiature fuse shown in FIG. 4.
Figure 8:
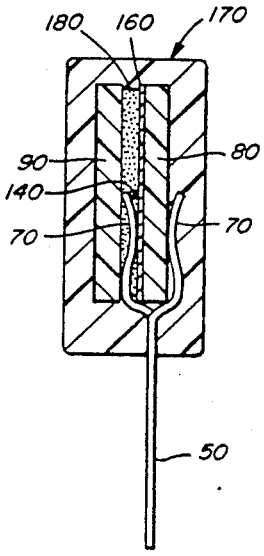
Figure 9:
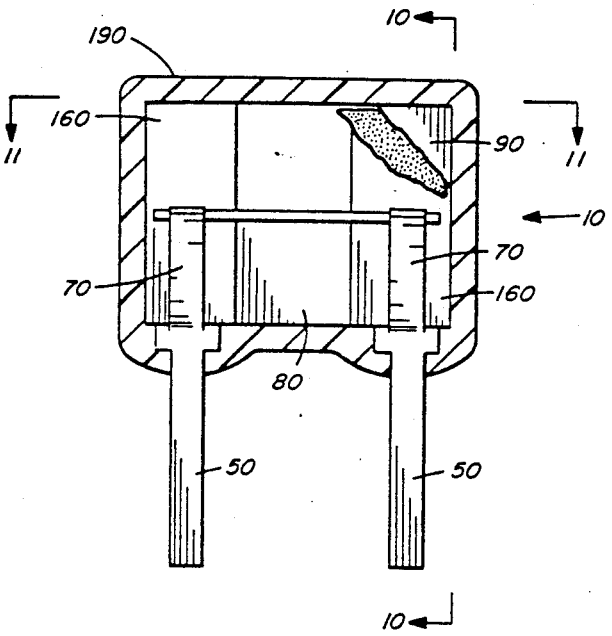
Figure 10:
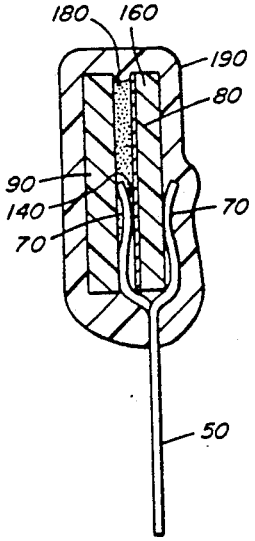
Figure 11:
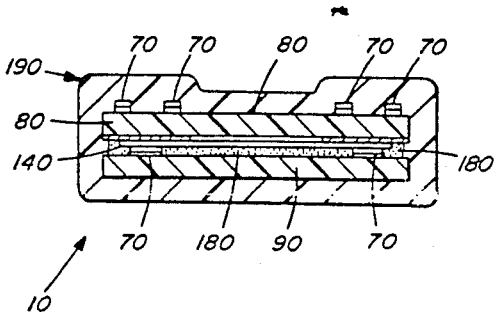

FIG. s is a side sectional view of the fuse shown in FIG. 7, along lines 8—8;

FIG. 9 is a front view of an alternate embodiment of the subminiature fuse in accordance with the present invention;

FIG. 10 is a side sectional view of the subminiature fuse shown in FIG. 9, along the lines 10—10;

FIG. 11 is a top sectional view of the subminiature fuse shown in FIG. 9, along the lines 11—11.

DETAILED DESCRIPTION OF THE INVENTION

While this invention is susceptible of embodiment in many different forms, there is shown in the drawings, which will herein be described in detail, several preferred embodiments of the invention. It should be understood however that the present disclosure is to be considered as an exemplification of the principles of the invention and is not intended to limit the invention to the specific embodiments illustrated.

Referring to the drawings, FIG. illustrates an embodiment of the subminiature fuse 10 that is the subject of the present invention. The fuse 10 comprises a first terminal 20, a second terminal 30, an first insulating means 80, a second insulating means 90, a fusible conductor 140 a ceramic coating 180, shown in FIG. 3, and an enclosure 170, shown in FIG. 2.

The two terminals 20 and 30 are each comprised of a top portion 40 and a bottom portion 50. The bottom portion 50 of the terminals 20 and 30 is adapted to plug into a printed circuit (PC) board where it is soldered in place or into a fuse receptacle located on a PC board. The bottom portion 50 is essentially flat. Although the flat configuration is preferred, the invention is equally adaptable to other configurations, such as use of a circular cross section conductive material.

Terminal stops 60 can be located at a fixed distance from the end of the bottom portion 50 of each terminal 20 and 30. These stops 60 act as standoffs and are designed to limit the length that the bottom portions 50 of terminals 20, 30 can be inserted into a fuse receptacle. When the terminals 20 and 30 are inserted into a receptacle up to the stops 60, there is sufficient contact between the fuse terminals 20 and 30 and the connectors in the receptacle to establish the desired electrical connection. These stops 60 also prevent the housing 170 from contacting the printed circuit board in applications where the fuse is soldered directly on a PC board. Plastic standoffs can also be molded into the housing 170 and used to perform the same function as the stops 60.

Figure 5:
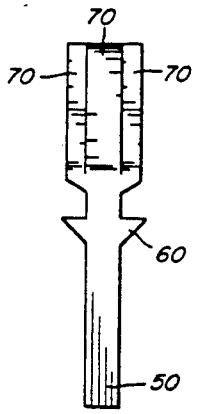
FIG. 5 is a front view of a fuse terminals of the subminiature fuse shown in FIG. 1.

The top portion 40 of the terminals 20 and 30 is comprised of two or more terminal fingers 70. The fingers 70 are best illustrated in FIG. 5. These terminal fingers are used for several purposes. One purpose is to provide mechanical holding of the insulating means or substrate 80 during the manufacturing process. Each finger 70 is comprised of two curved portions 100 and 110 each forming an S-like configuration. The fingers 70 are joined at one end, with the curvatures 100 and 110 of each finger opposing each other. The overall configuration is fork-like and provides a spring compressive force at a contact point 120, shown in FIG. 3. The tip 130 of each finger 70 is disposed at an acute angle relative to substrate 80. This will allow for the conductor 140 to be drawn between the terminal finger 70 and the substrate 80. This angle is made just large enough to allow a conductor 140 to fit between the tips 130 and the substrate 80 with minimal stress. Due to the fact that the conductor wire 140 has a small diameter, it is necessary to reduce or eliminate any potential stresses thereon.

In the preferred embodiment, the terminals 20 and 30 are made from copper alloy. However, other materials such as phosphor-bronze and beryllium-bronze and other alloys of electrical conducting materials are also suitable. In the preferred embodiment, the copper alloy conductors have a tensile strength close to phosphor-bronze. The tensile strength is preferably higher than the tensile strength of copper and lower than that of stainless steel. The terminals 20 and 30 are made by stamping from a flat piece of conductor stock. This process is very adaptable to forming three terminal fingers 70.

After the conductor material is stamped, the terminals 20 and 30 are coated with a tin or tin-lead composition so as to form a solder reflow joint. This process minimized the amount of tin or tin lead composition necessary to form the solder reflow joint After the conductor material is stamped into the three finger embodiment, the central finger 70 is separated from the two outside fingers 70 to form a U-shaped slot adapter to receive the substrate 80. Although three fingers are particularly adapted to providing the requisite mechanical strength to grasp the substrate 80, other embodiments could include the use of two, four or even more fingers.

An alternate method is to hot roll the tin or tin lead composition onto one side the flat conductor stock prior to stamping the terminals 20 and 30. This process minimizes the amount of tin or tin lead composition onto one side of the flat conductor stock prior to stamping the terminals 20 and 30. The coated conductor material is said to be solder clad.

The substrate 80 is used to mechanically link the two terminals 20 and 30. The substrate 80 is flat and rectangular and is generally a box-like shape. The minimum length of the substrate 80 between the terminals 20 and 30 is determined by the requisite spark gap required to interrupt an arc generated by a predetermined system voltage and excess current. However the length may be increased to facilitate handling during the manufacturing process.

During the arc interruption cycle, the temperature in the fuse housing can exceed 400° F. Since the substrate 80 is necessary to mechanically link the terminals 20 and 30 and to maintain the requisite spark gap distance, it is important that the substrate 80 not break down electrically during the interruption cycle. Similarly, substrate 90 must not break down during the interruption cycle and allow the high temperature to rupture the enclosure 170. Such electrical breakdown of the substrates 80 or 90 could cause catastrophic failure of the fuse. Also, it is important to use a material that will not carbonize at high temperatures, since that would support electrical conduction. For this reason, a material having the ability to withstand high temperature must be used. In the preferred embodiment, the substrates 80 and 90 are comprised of a ceramic material such as alumina or silica. However, various other ceramic materials such as magnezia, beryllia ceramic, mica and some organic fiber composites are also suitable.

Another important consideration in selecting the substrates 80 and 90 is that it have good dielectric properties. Poor dielectric materials would allow conduction across the substrate 80 or 90 during interruption. This could result in an increased interruption time and therefore catastrophic failure of the fuse 10. Ceramic materials, as well as being good thermal insulators, have excellent electrical dielectric strength and are therefore suitable for use as a material for the substrates 80 and 90.

Each end 160 of the substrate 80 is metallized to form a connection means for the terminals 20 and 30 and the fusible conductor. In the preferred embodiment, the metallizing is done with silver. In addition to being a good electrical conductor, it is desirable that the conductive material deposited on the substrate 80 have a very high density and also be relatively easy to process. Since silver can be fired or sintered in air, unlike copper, which must be sintered in the presence of nitrogen, silver is preferred. Other conductor materials, such as gold are equally suitable as conductor materials for the substrate. However, due to the cost factor, silver is preferred.

After the silver is deposited onto the substrate ends 160 and fired, the ends are next dipped into a tin or tin lead bath. This reduces oxidation and forms a solder reflow joint It is important that the solder reflow composition (e.g., tin lead) deposited onto the terminals 20 and 30 have the same melting temperature as the solder reflow composition into which the substrate ends 160 are dipped When the melting temperatures are the same or close to the same a solder joint can be made by placing the terminals 20 and 30 in contact with the substrate ends 160 and merely applying heat. Without adding any additional solder, a solder joint is created when the solder reflow composition on the terminals 20 and 30 and on the substrate ends 160 reaches the melting point and is subsequently allowed to cool. Since the contacting points of the terminals 20 and 30 are completely covered with the solder reflow composition, as are the ends 160 to the substrate 80, a better solder joint is formed than would be if external solder material were applied to form the joint.

The fusible conductor 140 is connected between the two terminals 20 and 30 to form an electrical current path. The cross-section of the conductor is determined by the particular conductive material used. The normal current that will pass through the fuse 10 and the excess current fusing value desired. The fusible conductor can be a wire, a thick film, a thin film or any other form of conductor common to the industry.

Since a fuse 10 is placed in series with the device to be protected, it is necessary that the fuse 10 carry normal current without spurious failure. Therefore the conductor must be sized to pass the normal current without fusing. Also, the resistance of the particular conductor material must be considered. Conductors having a relatively low resistance can carry more current without fusing than conductors of the same size having a higher resistance. For example, nickel has a higher resistance than copper, therefore if nickel is used as a conductive material, a larger cross section of nickel conductor than copper conductor is necessary to carry the same current.

There are also other factors which influence conductor size. One, for instance, is the ability of the conductor to dissipate heat resulting from passing current through the conductor. The ceramic coating 180 is placed around and conducts heat away from the fusible conductor 140. The ceramic coating 180 also acts to absorb the metal vapor during the interruption, thus reducing the arc plasma temperature. The solid interior of the insulating coating allows for only a very minute cylindrical chamber or volume to be pressurized. This volume is defined by the volume occupied by the fusible conductor 140 prior to vaporization thereof. Since the gas created by the arc must be contained in such a small area, this results in a much higher local pressure within the arc channel than in an air filled housing as taught, for example, by Asdollahi. Thus, fast clearing circuit interruption is attained at higher ampere applications.

The conductor 140 is connected between the two terminals 20 and 30 by placing it between the substrate ends 160 and the tips 130 of the terminal fingers 70. Due to the solder cladding on the inside of the terminal fingers 70 and the substrate edges 160, the conductor 140 is fastened to terminal fingers 70 and the substrate ends 160 by heating up the contact point and allowing it to cool, thus forming a solder joint by the solder reflow method.

The ceramic coating 180 is applied directly over the conductor 140. The amount of ceramic for the coating 180 is sufficient to cover the portion of the conductor 180 betWeen terminals 20 and 30. Substrate 90 is then pressed onto the ceramic coating 180, effectively squeezing out any air pockets or voids that remained near conductor 140 during the application process. The ceramic coating 140 acts as an adhesive, fastening substrates 80 and 90 together.

Figure 3:
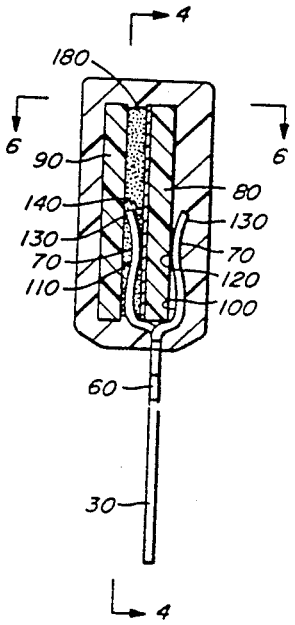
FIG. 3 is a sectional view of the subminiature fuse shown in FIG. 2, along lines 3—3.
Figure 4:
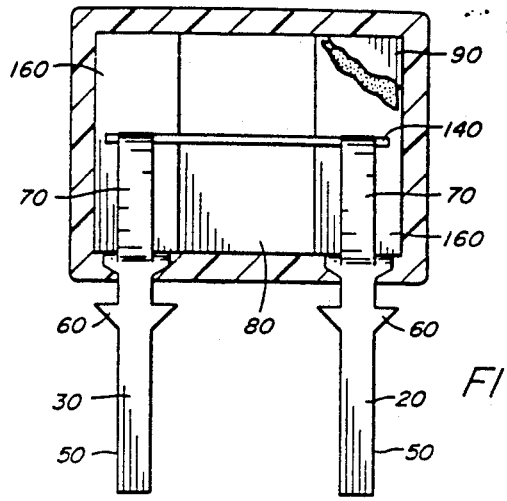
FIG. 4 is a sectional view of the subminiature fuse shown in FIG. 3, along lines 4—4.

The ceramic coating 180 is in communication with substrates 80 and 90 as illustrated in FIG. 3. The substrate 90 is placed between the hot spot of the conductor and the enclosure 170 as illustrated in FIG. 3. Both substrates 80 and 90 protect the enclosure 170 from the heat generated during the interruption cycle. Both substrates 80 and 90 physically support the ceramic coating 180 in order to maintain pressure around the arc during the interrupt event. The substrate 90 is used to insulate the enclosure 170 from the heat generated during the interruption cycle, and protect the enclosure 170 from electrical breakdown. The substrate 90 is flat and rectangular, generally a box-like shape, and although not necessary, in the preferred embodiment is the same size and shape as substrate 80. Substrate 90 protects the area of enclosure 170 that would be subject to heating by the arc generated during the interruption cycle. To perform this function, substrate 90 should be the same size and distribution of the ceramic coating 180. By insulating the enclosure 170 from excess heat, the enclosure 170 remains intact and prevents a catastrophic failure of the fuse.

Figure 2:
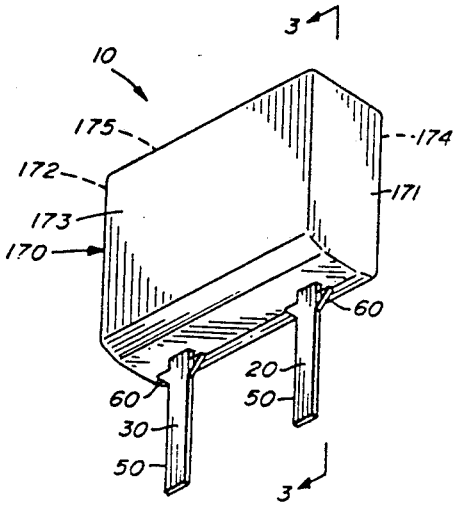
FIG. 2 is a perspective view of a subminiature fuse according to the present invention.
Figure 1:
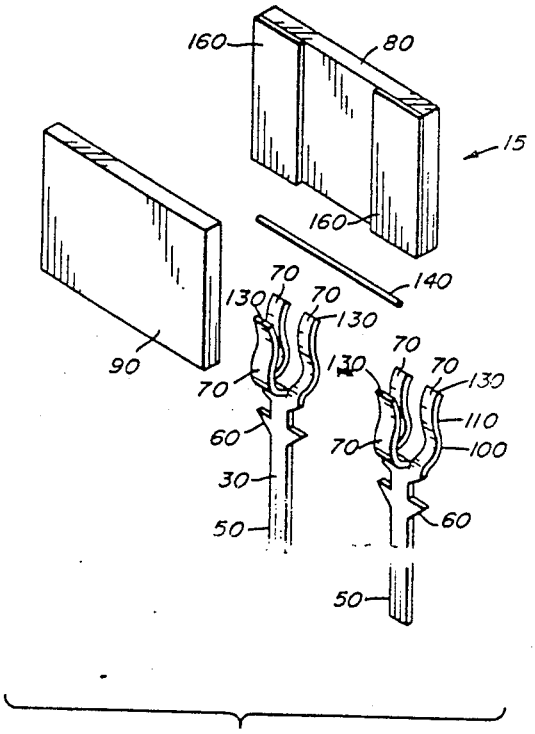
FIG. 1 is an exploded perspective view of a subminiature fuse in accordance with the present invention.

The terminals 20 and 30, substrates 80 and 90, the conductor 140, and the ceramic coating 180 form an assembly 15. This assembly, in one embodiment, is housed in a one piece plastic box-like enclosure or housing 70, which is best illustrated in FIG. 2. The housing 170 is made of plastic material and is generally of a box-like shape.

Figure 6:
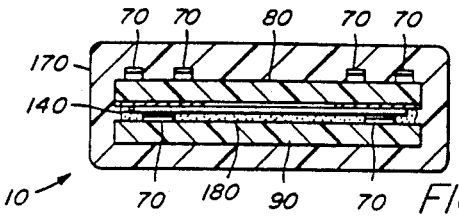
FIG. 6 is a top sectional view of the subminiature fuse shown in FIG. 3, along lines 6—6.
Figure 6A:
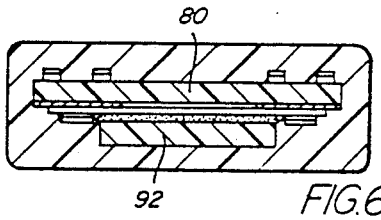
FIG. 6A is a top sectional view of an alternate embodiment of a subminiature fuse.

FIG. 6A illustrates an alternate embodiment wherein substrate 92 is smaller than substrate 80. Thus only the hot spot created by fusible element 140 is covered the size of fuse 10 and the cost of materials.

FIGS. 9 through 11 illustrate the preferred embodiment, which further improves the short circuit performance of a subminiature fuse shown in FIGS. 1 through 8. This embodiment comprises the fuse assembly as heretofore described inserted into a one-piece or unitary housing or into a plastic mold. In the mold, molten plastic, typically at thousands of pounds of pressure per square inch, is injected into or compressed in the mold to form a homogeneous one piece housing 190 around the assembly so that no air is trapped within. This method of making the housing is known in the art as insert molding.

Thus, it should be apparent that a unique subminiature fuse is disclosed and a method for making the same. The fuse and the method for making them are readily adaptable to conventional design practices and automatable manufacturing techniques. Moreover, while the invention is described in conjunction with specific embodiments, it should be apparent that there are alternatives, modifications and variations which will be apparent to those skilled in the art of the foregoing description. Accordingly, it is intended to cover all such alternatives, modifications and variations that fall within the spirit and broad scope of the claims.

I claim:

1. An electrical circuit protector comprising:

a first terminal and a second terminal each having a top portion and a bottom portion;

a first insulating means having two ends for electrically and thermally insulating said first terminal from said second terminal and for holding said first terminal and said second terminal apart from each other by a predetermined distance, said top portions of said first terminal and said second terminal being disposed intermediate the ends of said first insulating means.

a second insulating means;

a fusible conductor connected between said first terminal and said second terminal, supported on said first insulating means, and located between said first and second terminal means;

a third insulating means coating said fusible conductor between said first terminal and said second terminal, and between said first insulating means and said second insulating means; wherein the combination of said first insulating means, said second insulating means, said fusible conductor, said third insulating means, and the portions of said first terminal and said second terminal define an assembly.

2. An electrical circuit protector according to claim 1, wherein said second insulating means comprises ceramic.

3. An electrical circuit protector according to claim 1, wherein said assembly is enclosed in a unitary one piece housing.

4. An electrical circuit protector according to claim 3, wherein said unitary enclosure means comprises epoxy.

5. An electrical circuit protector according to claim 3, wherein said unitary enclosure means is formed from molded plastic.

6. An electrical circuit protector according to claim 3, wherein the interior of said unitary enclosure is substantially devoid of air.

7. An electrical circuit protector according to claim 1, wherein said third insulating means comprises an adhesive.

8. An electrical circuit protector according to claim 1, wherein said top portion of said first terminal comprises a plurality of fingers which are disposed in a fork-like configuration and which are adapted to receive said first insulating means and to position said first terminal with respect to said first insulating means.

9. An electrical circuit protector according to claim 1, wherein said bottom portions of said first terminal and said second terminal are flat and define two ends.

10. An electrical circuit protector according to claim 1, wherein said bottom portion of said first terminal and said second terminal includes stop means, projecting from said bottom portion at a predetermined distance from one end of said first terminal for limiting the distance said first terminal and said second terminal can be inserted into a printed circuit board.

11. An electrical circuit protector according to claim 1, wherein said second insulating means is smaller than said first insulating means.

12. An electrical circuit protector according to claim 3, wherein said housing means has integrally molded plastic stand off means for limiting the distance that said first terminal and said second terminal can be inserted into a printed circuit board.

13. An electrical circuit protector according to claim 1, wherein said first insulating means and said second insulating means comprises a ceramic substrate.

14. An electrical circuit protector according to claim 13, wherein said first insulating means and said second insulating means have a general box-like rectangular shape.

15. An electrical circuit protector according to claim 1 wherein said edges of said first insulating means are coated with a metal to facilitate soldering of said first terminal and said second terminal thereto.

16. An electrical circuit protector according to claim 1 wherein said fusible conductor is connected to said first terminal and said second terminal by soldering.

17. An electrical circuit protector according to claim 3, wherein the cross section of said unitary housing means is substantially rectangular having one end through which said assembly is inserted adapted to sealed around assembly.

18. An electrical circuit protector according to claim 17 wherein said unitary housing means is made of a plastic material.

19. An electrical circuit protector according to claim 3, wherein said enclosure means is comprised of an insert molded plastic body.

20. A method of manufacturing a subminiature fuse, comprising the steps of:

positioning two blade type terminals generally parallel to one another, each of said terminals having an upper portion and a lower portion, said upper portions having a pair of fingers;

assembling a first ceramic substrate between said two fingers on an upper portion of each of said blade type terminals such that the blade type terminals are oppositely disposed along an edge of said first ceramic substrate;

soldering a fuse conductor between said blade type terminals;

applying an insulative coating over said fuse conductor, which coats, at a minimum, the portion of the fuse conductor between said blade type terminals;

position a second ceramic substrate along the first ceramic substrate in such a way as to sandwich said fuse conductor and said insulative coating between said first ceramic substrate and said second ceramic substrate to form an assembly; and enclosing said assembly in a one piece housing.

21. Method of manufacturing a subminiature fuse according to claim 20, wherein said blade type terminals have solder alloy cladding on an inside surface of said fingers, wherein said first substrate has metallized ends which contact said fingers or said terminals and, wherein said fuse conductor has two ends, said fuse conductor is connected to said terminals by placing between said metallized ends and said cladding by solder reflow between said fingers and the first substrate.

22. An electrical circuit protector which is adapted to be inserted into a printed circuit board, comprising:

a first terminal and a second terminal each having a top portion and a bottom portion;

a first insulating means having two ends for electrically and thermally insulating said first terminal from said second terminal and for holding said first terminal and said second terminal spaced apart from each other by a predetermined distance, said top portions of said first terminal and said second terminal being disposed intermediate the ends of said first insulating means, wherein said top portion of said first and said second terminal comprises plurality of fingers which are disposed in a fork-like configuration and which are adapted to receive said first insulating means and to position said first terminal with respect to said first insulating means;

a fusible conductor connected between said first terminal and said second terminal and supported on said first insulating means;

a third insulating means that coats said fusible conductor between said first terminal and said second terminal; and a second insulating means positioned between said first terminal and said second terminal along said first insulating means such that said fusible conductor lies between said first insulating means and said second insulating means, the combination of said first insulating means, said second insulating means, said fusible conductor, said third insulating means, and the top portions of said first terminal and said second terminal defining an assembly.

23. An electrical circuit protector according to claim 22, wherein said assembly is housed in a unitary one enclosure.

24. An electrical circuit protector according to claim 22, wherein said fusible conductor is disposed between one of said fingers and said first insulating means.

25. An electrical circuit protector according to claim 22, wherein said fingers at said top portion of said first terminal are coated with a solder alloy cladding material.

26. An electrical circuit protector according to claim 22, wherein said second insulating means is disposed between said fingers such that said fusible conductor lies between said first insulating means and said second insulating means.

27. An electrical circuit protector which is adapted to be inserted into a printed circuit board, comprising:

a first terminal and a second terminal each having a top portion and a bottom portion;

a first insulating means having two ends for electrically and thermally insulating said first terminal from said second terminal and for holding said first terminal and said second terminal spaced apart from each other by a predetermined distance, said top portions of said first terminal and said second terminal being disposed intermediate the ends of said first insulating means;

a fusible conductor connected between said first terminal and said second terminal and supported on said first insulating means;

a third insulating means that coats said fusible conductor between said first terminal and said second terminal;

a second insulating means between said first terminal and said second terminal and along said first insulating means such that said fusible conductor lies between said first insulating means and said second insulating means, the combination of said first insulating means, said fusible conductor, and the portions of said first terminal and said second terminal defining an assembly; and unitary one piece enclosure means for housing said assembly wherein said unitary enclosure means is in the form of a box-like structure comprising two oppositely disposed pair of faces, defining a generally rectangular opening, one pair of said faces having V-shaped notches which are oppositely disposed to each other, said opening defining two lips which are oppositely disposed from each other and which are disposed adjacent to each other for sealing said opening.

28. A circuit protector as in claim 27 wherein said first terminal and said second terminal are in substantially parallel relationship to each other.

* * * * *